US007062221B1

(12) United States Patent
Christensen

(10) Patent No.: US 7,062,221 B1
(45) Date of Patent: Jun. 13, 2006

(54) WIRELESS REMOTE CONTROL SYSTEM FOR EXTENDABLE MASTS

(75) Inventor: Jerry A. Christensen, Wooster, OH (US)

(73) Assignee: The Will-Burt Company, Orrville, OH (US)

( * ) Notice: Subject to any disclaimer, the term of this patent is extended or adjusted under 35 U.S.C. 154(b) by 462 days.

(21) Appl. No.: 10/114,713

(22) Filed: Apr. 2, 2002

Related U.S. Application Data

(60) Provisional application No. 60/309,442, filed on Aug. 2, 2001.

(51) Int. Cl.
*H04H 1/00* (2006.01)

(52) U.S. Cl. ..... 455/3.01; 455/3.03; 340/825.69; 340/825.37

(58) Field of Classification Search ..... 455/3.01, 455/562.1, 273, 267.1, 3.03; 362/385, 526; 343/882, 901, 702; 348/64, 144; 137/1, 137/615; 340/825.69, 825.37, 310.11; 375/133, 375/132

See application file for complete search history.

(56) References Cited

U.S. PATENT DOCUMENTS 4,418,333 A * 11/1983 Schwarzbach et al. . 340/310.11
4,728,949 A * 3/1988 Platte et al. ..... 340/825.37
5,163,650 A 11/1992 Adams et al.
5,281,975 A * 1/1994 Hugo ..... 343/766
5,434,614 A * 7/1995 Dainty ..... 348/64
5,572,837 A 11/1996 Featherstone et al.
5,593,129 A 1/1997 Adams et al.
5,615,855 A 4/1997 Marue et al.
5,689,821 A * 11/1997 Shimazaki ..... 708/109
5,743,635 A 4/1998 Hulse et al.
5,823,218 A * 10/1998 Schlecht et al. ..... 137/2
5,892,360 A * 4/1999 Willer et al. ..... 324/326
5,980,070 A * 11/1999 Hulse et al. ..... 362/385
5,990,809 A * 11/1999 Howard ..... 340/988
6,037,913 A * 3/2000 Johnson ..... 343/882
6,111,542 A * 8/2000 Day et al. ..... 342/359
6,290,377 B1 * 9/2001 Hulse ..... 362/385
6,299,336 B1 10/2001 Hulse
6,462,775 B1 * 10/2002 Loyd et al. ..... 348/151
6,476,778 B1 * 11/2002 Hussaini et al. ..... 343/901
6,582,105 B1 * 6/2003 Christensen ..... 362/385

(Continued)

OTHER PUBLICATIONS

U.S. Appl. No. 60/309,442, filed Aug. 2, 2001.

(Continued)

*Primary Examiner*—Doris H. To
*Assistant Examiner*—Tan Trinh
(74) *Attorney, Agent, or Firm*—Fay, Sharpe, Fagan, Minnich & McKee, LLP

(57) ABSTRACT

A wireless remote control system is provided for use with an extendable mast arrangement. The wireless remote control system includes a wireless remote control and a base. The wireless remote control has an operator interface for the input of mast control commands and/or devices on the mast and a transmitter for outputting electromagnetic waves that correspond to mast control and/or other device commands inputted by the operator. The base includes a receiver for receiving electromagnetic control commands from the wireless remote control, and a converter for converting the electromagnetic control commands into electric command signals suitable for the control system of the extendable mast arrangement. The base is in electrical communication with the control system of the extendable mast arrangement and is configured to communicate the electrical command signals to the control system.

20 Claims, 4 Drawing Sheets

U.S. PATENT DOCUMENTS

| | | | | |
|---|---|---|---|---|
| 6,624,605 | B1 * | 9/2003 | Powder et al. | 318/445 |
| 2004/0038714 | A1 * | 2/2004 | Rhodes et al. | 455/562.1 |
| 2004/0077267 | A1 * | 4/2004 | Ganz | 446/176 |

OTHER PUBLICATIONS

U.S. Appl. No. 60/332,607, filed Nov. 16, 2001.

* cited by examiner

WIRELESS REMOTE CONTROL SYSTEM FOR EXTENDABLE MASTS

The present invention claims priority on U.S. Provisional Patent Application No. 60/309,442 filed Aug. 2, 2001, which is incorporated herein by reference.

The subject invention relates to the art of control systems for extendable masts, and more particularly to a wireless remote control system that is adapted to interface with an existing control system on an installed and functional extendable mast.

INCORPORATION BY REFERENCE

U.S. Pat. Nos. 5,163,650; 5,593,129; 5,572,837; 5,615,855; 5,743,635; 5,980,070; 6,290,377; and 6,299,336; and co-pending U.S. Provisional Patent No. 60/332,607 filed Nov. 16, 2001 are incorporated herein by reference as background art and as examples of masts that can be used with the present invention.

BACKGROUND OF THE INVENTION

Control systems for extendable masts have been provided heretofore, and generally, as shown in U.S. Pat. No. 5,743,635 for example, have a mast that is moveable between a retracted position and an extended position. One end of the mast is pivotally mounted to a base that is secured to a transport vehicle. In the retracted position, the mast is of compact length and can be pivoted at the base thereof toward a position generally horizontal and parallel with the roof of the transport vehicle. In such a retracted and horizontally stowed position, the mast is secured in place and the vehicle can be driven in the typical manner. As the need arises, the vehicle is parked in a suitable position adjacent the area where the mast is to be deployed, and the secured mast unsecured. At this point, a control panel mounted on and/or within the vehicle and/or a wired control pad for controlling the power source for erecting the mast is employed to pivot the mast into an upright position and to extend the mast. The mast need not be moved into a substantially vertical position. Rather, the mast may be pivoted into a position in which the extended end of the mast most suitably approaches or overhangs the deployment site.

Generally, lights, such as spot lights, flood lights, or other high output lights, will be on the extended end of the mast so that the elevation of the extended end will permit the lights to shine downwardly on the deployment site. As can be appreciated, devices other than lights can be connected to the end of the mast (e.g. cameras, antennas, dishes, microphones, monitors, flags, baskets, etc.). It should be noted that the deployment site may be a construction area, an accident site, or any other area temporarily requiring illumination and/or other device. It should also be noted that the site is often dynamically changing so that the focus and position of the lights, and/or other device, may need to be frequently adjusted. The lights and/or other devices at the end of the mast often include motorized mounting arrangements that allow the lights and/or other devices to pan about a vertical axis or rotate about a horizontal axis. Such motorized mounting arrangements are controlled by and/or moved in response to electrical signals generated by a control panel and/or wired control pad, such as will be described hereinafter. Typically, such as is shown in U.S. Pat. No. 5,743,635, a control panel is mounted within the vehicle that can be used to position the mast, and therefore the lights and/or other devices attached thereto, as desired. However, this makes the task of properly positioning and directing the lights and/or other devices difficult because the operator is accessing the control panel from inside the vehicle, and therefore the operator may be unable to see the position of the mast and lights and/or other devices. This difficulty has been at least partially resolved, as discussed in U.S. Pat. No. 5,743,635, by providing an external receptacle in the mounting base of the mast. The receptacle receives a plug from a hand-held control pad. The control pad communicates with the control circuitry in the base of the mast in the same way that the control panel inside the vehicle does; that is, by sending a series of electrical signals through the internal wiring from the control panel, and/or through the external plug from the control pad, to the control circuitry in the base of the mast. In both cases, the appropriate electrical signals are generated in response to the depression of control buttons on either the control panel or external control pad. The provision of an external control pad that has a wire that plugs into the base improves the operator's ability to position the mast and lights and/or other devices during initial deployment of the mast, by allowing the operator to stand outside the vehicle and view the position of the mast and lights and/or other devices during deployment.

One disadvantage of the wired control pad is that the operator must return to the vehicle to reposition the mast and/or lights after initial deployment, as the illumination needs and/or other device needs in the deployment area change. The wire from the control pad to the external receptacle of the base can be cumbersome and/or otherwise problematic to use if it is too long. Furthermore, a long wire from a control pad can be damaged if allowed to extend across a construction site or emergency area. As a result, the wire on an external control pad is relatively short, requiring that the operator be near the vehicle to adjust the mast and lights and/or other devices. This is a disadvantage if the operator must leave his or her current task to return to the vehicle and adjust the mast and lights and/or other devices.

In view of the present state of the telescoping masts, there is a need for a mast control system that enables an operator to easily and conveniently operate the mast at a remote location.

SUMMARY OF THE INVENTION

In accordance with the present invention, there is provided a wireless remote control system for extendable masts that overcomes or minimizes the problems and difficulties encountered with the use of devices of the foregoing character, while promoting or maintaining the desired rapid installation and simplicity of use, durability of construction, and economy of manufacture. The present invention pertains in part to a wireless remote control system that can be used independently from or in conjunction with a control panel mounted on and/or within the vehicle and/or a wired control pad as disclosed in U.S. Pat. No. 5,743,635. The wireless remote control system enables an operator to control the mast position and/or components on the mast from a location remote to the mast without having to lay a control line between the operator and the mast. As such, the problems associated with prior mast control arrangements are overcome.

In accordance with the present invention, the wireless remote control system includes a wireless hand-held remote control and a remote control base. The wireless hand-held remote control includes a housing, a keypad on an outside surface of the housing, a power supply, and a transmitter for sending signals to the remote control base. The power supply is typically a standard chemical battery; however the battery can include, or alternatively be, another type of battery such as, but not limited to, a solar battery, fuel cell, etc. The control keys are typically designed to correspond to the various functions and movements of the mast and/or components of the mast (e.g. lights, cameras, antennas, dishes, microphones, monitors, flags, baskets, etc.). The hand-held remote control can also include one or more video monitors, one or more analog and/or digital outputs, one or more visual indicators, etc. The size and/or shape of the hand-held remote control is non-limiting. Typically, the size, shape and weight of the hand-held remote control is selected so that the operator can conveniently and easily convey, handle and operate the hand-held remote control without the assistance of another individual. The hand-held remote control is designed to transmit one or more communication signals to the remote control base in response to the operator's manipulation of the control keys such as, but not limited to, positioning the mast, activating and/or deactivating one or more devices on the mast, operating one or more devices on the mast, positioning one or more devices on the mast, etc. As can be appreciated, the hand-held remote control can include a receiver to receive one or more communication signals from the remote control base. Such communication signals from the remote control base can include, but are not limited to, information on the position or the mast and/or other device on the mast, information on the operation of the devices on the mast, information on malfunctions of the mast and/or device on the mast, etc. The hand-held remote control can also be designed to control more than one mast and/or device on the mast. In some situations, multiple masts may be needed. In such situations, a single hand-held remote control can be used to control two or more of these masts. In such a design, the hand-held remote control typically includes a switch and/or accepts a identification code to designate which mast and/or devices on the mast are to be controlled, so as to prevent inadvertent operation of one mast and/or devices on the mast while another mast and/or devices on the mast are being controlled. As can be appreciated, the hand-held remote control can be operated at a significantly greater distance than a wired control pad having a short cable, and will also overcome the inconveniences and other limitations associated with the use of a wired control pad having a long or short extension cable. Accordingly, the operator will be able to remain in the work or emergency area and continue to perform his or her task in that area, stopping only briefly to manipulate the control keys of the hand-held remote control and thereby adjust the position of the mast and/or other devices to improve the positioning and/or operation thereof in light of changing circumstances or conditions.

In accordance with another and/or alternative aspect of the present invention, the wireless hand-held remote control transmits a signal from the transmitter that can be received by the remote control base. Typically, the signal is an electromagnetic signal that corresponds to the output from the manipulated keys of the keypad on the wireless hand-held remote control. As can be appreciated, such electromagnetic signal includes, but is not limited to, infrared signals, radio wave signals, microwave signals, etc.

In accordance with still another and/or alternative aspect of the present invention, the remote control base includes a receiver for receiving electromagnetic command signals from the transmitter of the wireless remote control, a cable extending to the receptacle of the mast base, a power supply, and a signal converter. The remote control base can be integrated into the control mechanism of the mast and/or can be connected to the existing control system of the mast. When the remote control base is integrated into the control mechanism, the control mechanism typically includes an antenna adapted to receive signals from the wireless hand-held remote, and/or the mast and/or an antenna on the mast is used to receive signals from the wireless hand-held remote. as can be appreciated, the antenna can be positioned in other locations. When the remote control base is to be connected to the existing control system of the mast, the remote control base typically includes a housing that contains one or more components of the remote control base such as, but not limited to, a receiver for receiving electromagnetic command signals from the transmitter of the wireless remote control, a transmitter for sending electromagnetic command signals to the transmitter of the wireless remote control, a signal converter, etc. In one embodiment, the remote control base includes one or more cables extending from the housing of the remote control base to the mast control system. In one aspect of this embodiment, the cable includes a plug and/or other type of connector to connect to an outlet that is adapted to connect to a wired keypad such as or similar to a wired keypad disclosed in U.S. Pat. No. 5,743,635. The plug can be designed to prevent both use of the wired keypad and the wireless remote control system, or can be designed to allow both the wired keypad and wireless remote control system be connected to the mast control system. In another and/or alternative aspect of this embodiment, the remote control base includes a signal converter. The control system in the existing base of the mast is designed to function in response to signals corresponding to the manipulation of the keypad on the control panel mounted inside the vehicle, and/or the manipulation of the keypad on the wired control pad that attaches to the mast base. As a result, the mast control system is not adapted to receive the electromagnetic command signals directly from the wireless remote control, and that even if the existing control system were so equipped, such signals would be in a language entirely foreign to and unsuitable for use by the existing control system. Accordingly, the remote control base includes a signal converter that receives signals from the wireless hand-held remote control and converts such signals into signals that can be understood by the mast control system. In one arrangement, the signal converter includes a microprocessor, or other suitable device, to convert the signals from the receiver in the remote control base to signals adapted to communicate with the control system in the existing mast base, which causes the mast and/or other devices to properly respond. In another and/or alternative arrangement, the convertor includes one or more filters that are used to identify the proper signal being transmitted from the wireless hand-held remote control. Typically, electromagnetic signals not produced from the wireless hand-held remote control (e.g. noise) are received by the receiver of the remote control base. The filters alone and/or in combination with other devices such as, but not limited to, a microprocessor, distinguishes the signal received from the wireless hand-held remote control and the received noise to as to ensure proper operation of the mast and/or devices on the mast. Other security and/or signal verification mechanisms can be used by the wireless hand-held remote control and/or remote control base to ensure proper operation of the mast and/or devices on the mast. In addition, the wireless hand-held remote control can include a security mechanism (e.g. key, security code, etc.) to prevent unauthorized use of the wireless hand-held remote control.

In accordance with yet another and/or alternative aspect of the present invention, the wireless remote control system can be stored inside the vehicle when the mast accessories are not being used. When needed, the wireless remote control and the remote control base can be removed from the interior of the vehicle and/or other storage location on the vehicle and installed. In one embodiment of the invention, the remote control base includes at least one hook, magnet, suction cup, and/or other attachment device to at least partially secure the remote control base to the vehicle or mast base. Once the remote control base is connected to the vehicle, the plug end of the cable from the remote control base housing can be inserted in the existing plug receptacle on the mast base. The existing plug receptacle is typically designed to accommodate the plug from the wired hand-held control pad; however, a separate plug receptacle can exist from the plug from the remote control housing. Once the remote control base is powered, and the wireless remote control system can be used.

The principal object of the present invention is to provide a wireless remote control system to control a mast and/or one or more devices on the mast.

Another and/or alternative object of the present invention is to provide a wireless remote control system for use with an existing extendable mast.

Still another and/or alternative object of the present invention is to provide a wireless remote control system having a wireless hand-held remote control, and a remote control base adapted to communicate command signals between the remote control and the control system of a mast to control the operation of the mast and/or one or more devices on the mast.

Yet another and/or alternative object of the present invention is to provide a wireless remote control system that can be stored inside the vehicle and installed on the vehicle or mast base upon arrival at the deployment site.

Still yet another and/or alternative object of the present invention is to provide a wireless remote control system that can be quickly connected to the interface receptacle of the control system of an existing mast base, and be immediately functional as a mast deployment and positioning control.

A further and/or alternative object of the present invention is to provide a wireless remote control system that can communicate commands from the wireless remote control to the existing control system of the mast and from the existing control system of the mast back to the wireless remote control.

Still a further and/or alternative object of the present invention is to provide a wireless remote control system that is easy and quick to install without tools, and is comprised of a minimal number of parts having a durable yet simple structure, thereby promoting the economic production of the wireless remote control system.

Yet a further and/or alternative object of the present invention is to provide a wireless remote control system that can be used independently from or in conjunction with control panel mounted on and/or within the vehicle and/or a wired control pad.

Still yet a further and/or alternative object of the present invention is to provide a wireless remote control system that includes security and/or signal verification mechanisms to ensure proper operation of the mast and/or devices on the mast.

These and other advantages will become apparent to those skilled in the art upon the reading and following of this description taken together with the accompanied drawings.

BRIEF DESCRIPTION OF THE DRAWINGS

Reference may now be made to the drawings, which illustrate various embodiments that the invention may take in physical form and in certain parts and arrangements of parts wherein.

DESCRIPTION OF PREFERRED EMBODIMENTS

Figure 1:
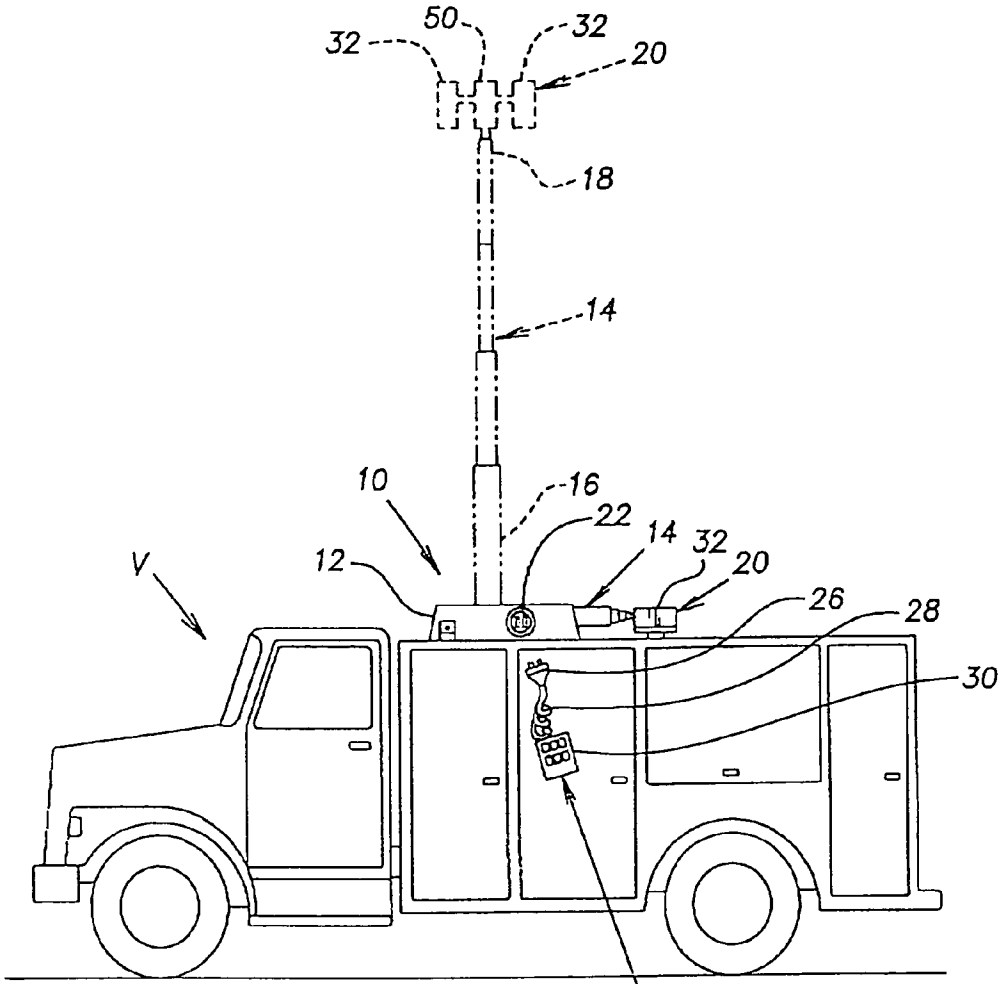
FIG. 1 (PRIOR ART)
FIG. 1 is a side view of a vehicle equipped with a mast and mast base, and the mast base having a prior art wired control pad associated therewith.

Referring now to the drawings wherein the showing is for the purpose of illustrating preferred embodiments of the invention only and not for the purpose of limiting the same, FIG. 1 illustrates a vehicle V having an extendable mast arrangement 10 thereon. Mast arrangement 10 includes a base 12 that is suitably secured to and supported by vehicle V, and an extendable mast 14 pivotally attached to the base. Mast 14 is shown as having four telescoping sections. However, it will be appreciated that masts are available in many sizes and configurations, and that the subject invention is not limited to any one mast arrangement. Mast 14 has a base end 16 and a tip end 18. Base end 16 is pivotally attached to base 12 for movement between a generally horizontal, stowed position and a deployed position that may range from nearly horizontal to generally vertical. Mast 14 is generally fully telescopically collapsed when in the stowed position, and may be partially or fully extended when deployed. It will be appreciated that in many mast arrangements, the mast may be infinitely adjusted between the fully collapsed and fully extended lengths. It will be further appreciated that in many mast arrangements, the mast may be infinitely positioned between the horizontal station and the generally vertical station, and that the mast may, in some arrangements, be pivoted beyond the 90° vertical position. The configuration and operation of some of these masts is disclosed in more detail in U.S. Pat. Nos. 5,163,650; 5,593,129; 5,572,837; 5,615,855; 5,743,635; 5,980,070; 6,290,377; and 6,299,336; and co-pending United States Provisional Patent No. 60/332,607 filed Nov. 16, 2001, all of which are incorporated herein by reference.

The extension and retraction of mast 14, and the positioning of the mast between its horizontal and vertical stations, is facilitated by a control system. The control system includes at least one interface, such as wired control pad 24, for the input of commands by an operator. The control system may also include motors, solenoids, power supplies, microprocessors, and other such electrical devices as may be suitable for effectively maneuvering mast 14. Additionally, the control system may include pneumatic, hydraulic, or other such components. These components may likewise be configured to respond to commands input from control pad 24 through their suitable interface with the control system. As such, the control system may take the form of a non-centralized, but integrated, collection of components, portions of which may be located on base 12, at tip end 18 of mast 14, or within one or more compartments of vehicle V. The control systems of some of these masts are disclosed in more detail in U.S. Pat. Nos. 5,163,650; 5,593,129; 5,572,837; 5,615,855; 5,743,635; 5,980,070; 6,290,377; and 6,299,336; and co-pending U.S. Provisional Patent No. 60/332,607 filed Nov. 16, 2001, all of which are incorporated herein by reference. Accordingly, it is not necessary to describe herein all of the various components and configurations of control systems for extendable masts currently in use or being developed. The subject invention is partially directed toward conforming to the interface used to input control commands.

Base 12 includes a communication port 22 that is in electrical communication with the control system of mast arrangement 10. Control pad 24 includes a cord 28 extending therefrom that terminates at plug 26. Port 22 and plug 26 are complementary, and port 22 receivably engages plug 26, thereby placing control pad 24 and the control system in electrical communication with the input of commands from pad 24. Control pad 24 includes a plurality of control keys 30 corresponding to one or more movements or functions of mast 14. Pad 24 may include additional control keys 30 corresponding to various functions or movements of one or more devices, such as light 20, that may be supported on tip end 18 of mast 14. It will be appreciated that such devices could vary widely in function and form, but that these functions may be effectively controlled through input commands corresponding to the displacement of keys 30, whereby command signals are electrically communicated through the control system from pad 20. The configuration and operation of one type of control panel 24 is disclosed in U.S. Pat. No. 5,743,635, which is incorporated herein by reference.

Figure 2:
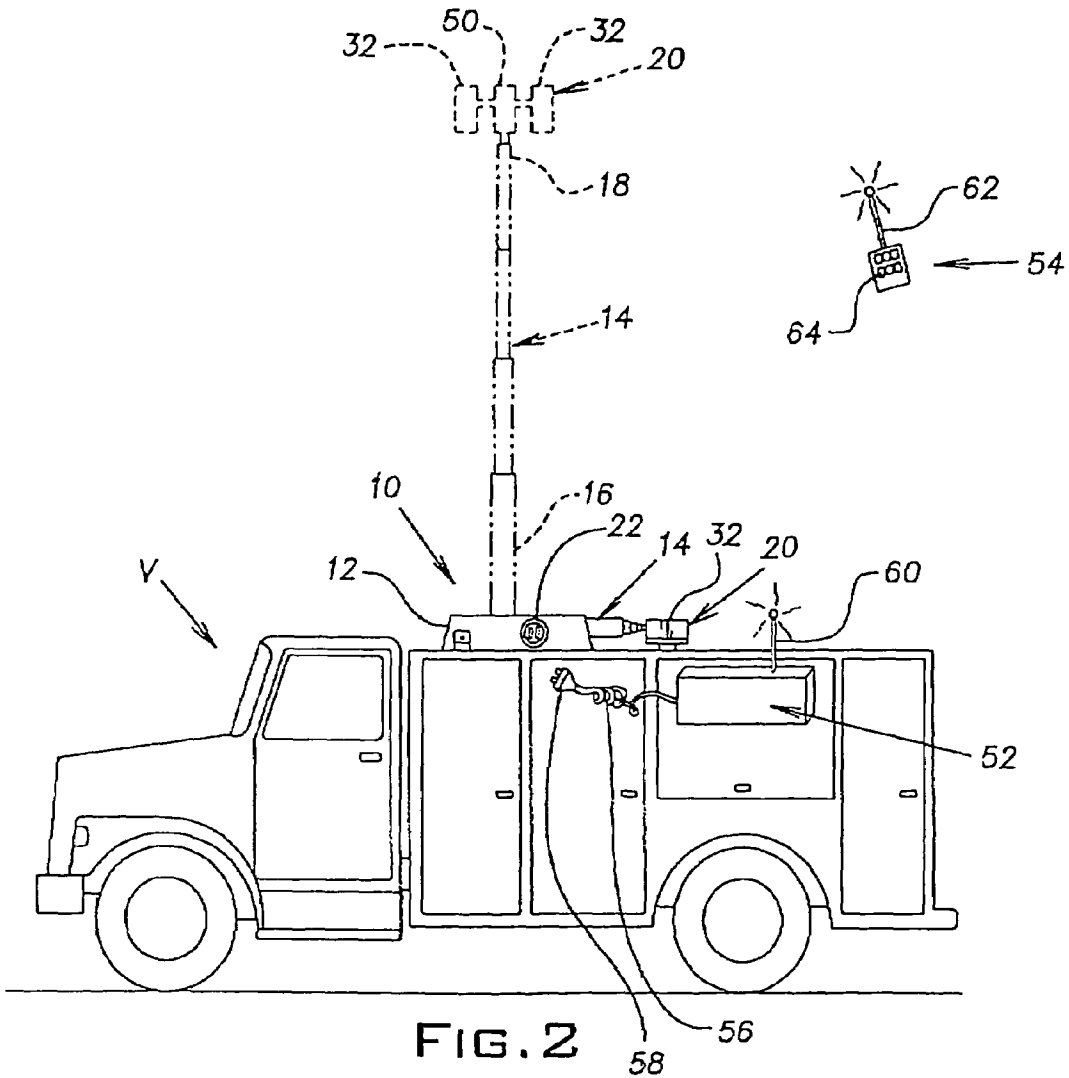
FIG. 2 is a side view of the vehicle shown in FIG. 1, with the wired control pad removed, and showing a wireless remote control system in accordance with the present invention for installation thereon.
Figure 3:
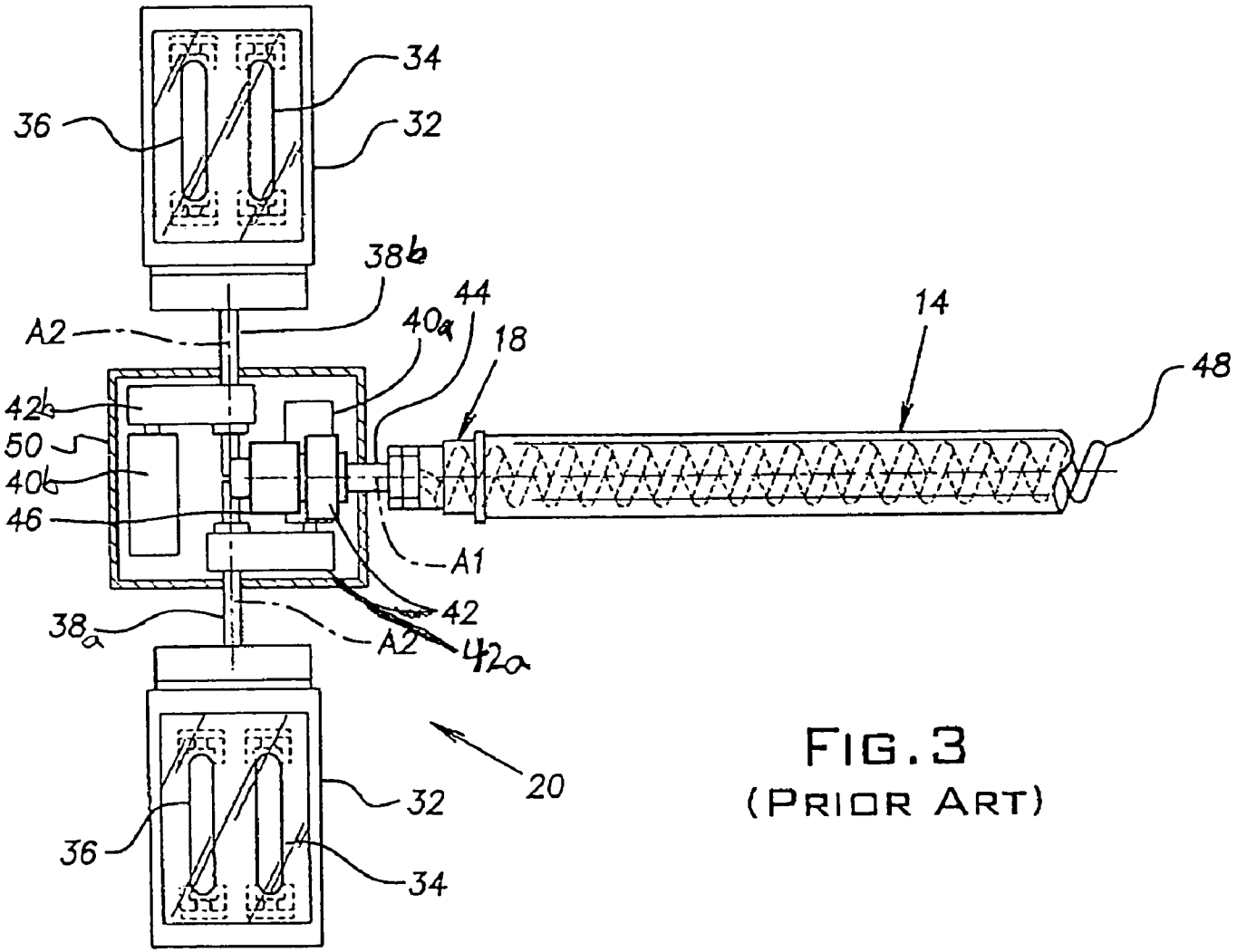
FIG. 3 (PRIOR ART)
FIG. 3 is a partial sectional view of a prior art mast and light.

FIG. 2 illustrates vehicle V and extendable mast arrangement 10 of FIG. 1 with control pad 24 removed. Mast 14 includes light 20 supported at tip end 18. As best seen in FIG. 3, light 20 is comprised of two independently tiltable light housings 32, each having a low-beam light source 34 and a high-beam light source 36. Typically, light sources 34 and 36 are high-output metal halide light sources; however, this is not required. Light 20 is pivotally supported at tip end 18 on a shaft 44 which extends co-axially with mast axis A1, and can pan about shaft 44 in response to rotational output of a pan motor, not shown, located in housing 50 and driveably engaging shaft 44 through a belt or gear 42. Housing 50 is supported on shaft 44 by bearings 46. Light housings 32 can tilt independently of one another, and are supported on opposing sides of housing 50 by separate shafts 38*a* and 38*b* having co-axial axes A2. Tilt motors 40*a* and 40*b*, respectively, drivingly engage shafts 38*a* and 38*b* through belts or gears 42*a* and 42*b*, and independently position housings 32 in response to the individual rotational output of each motor. Light 20 and the components thereof are electrically connected to the control system of mast arrangement 10 by wire 48.

Referring again to FIG. 2, vehicle V and mast arrangement 10 are shown with base unit 52 and wireless remote control 54. Base unit 52 includes a cord 56 that terminates at plug 58. Plug 26 of control pad 24 and plug 58 are substantially similar and are both complementary to port 22. Plug 58 engages port 22, thereby placing base unit 52 and the control system in electrical communication. It will be appreciated that plug 58 may include one or more adapters for interengaging port 22, since such ports may vary from mast arrangement to mast arrangement. Base unit 52 further includes an antenna 60 that sends and/or receives electromagnetic signals from remote control 54, which likewise includes an antenna 62 for sending and/or receiving electromagnetic signals. As can further be appreciated, the components of base unit 52 can be integrated into base 12, not shown. When base unit 52 is integrated into base 12, antenna 60 is typically positioned on base 12 and/or integrated on mast 14 and/or on components on mast 14. In this arrangement, base 12 typically is absent port 22; however, port 22 can be present on base 12.

Figure 4:
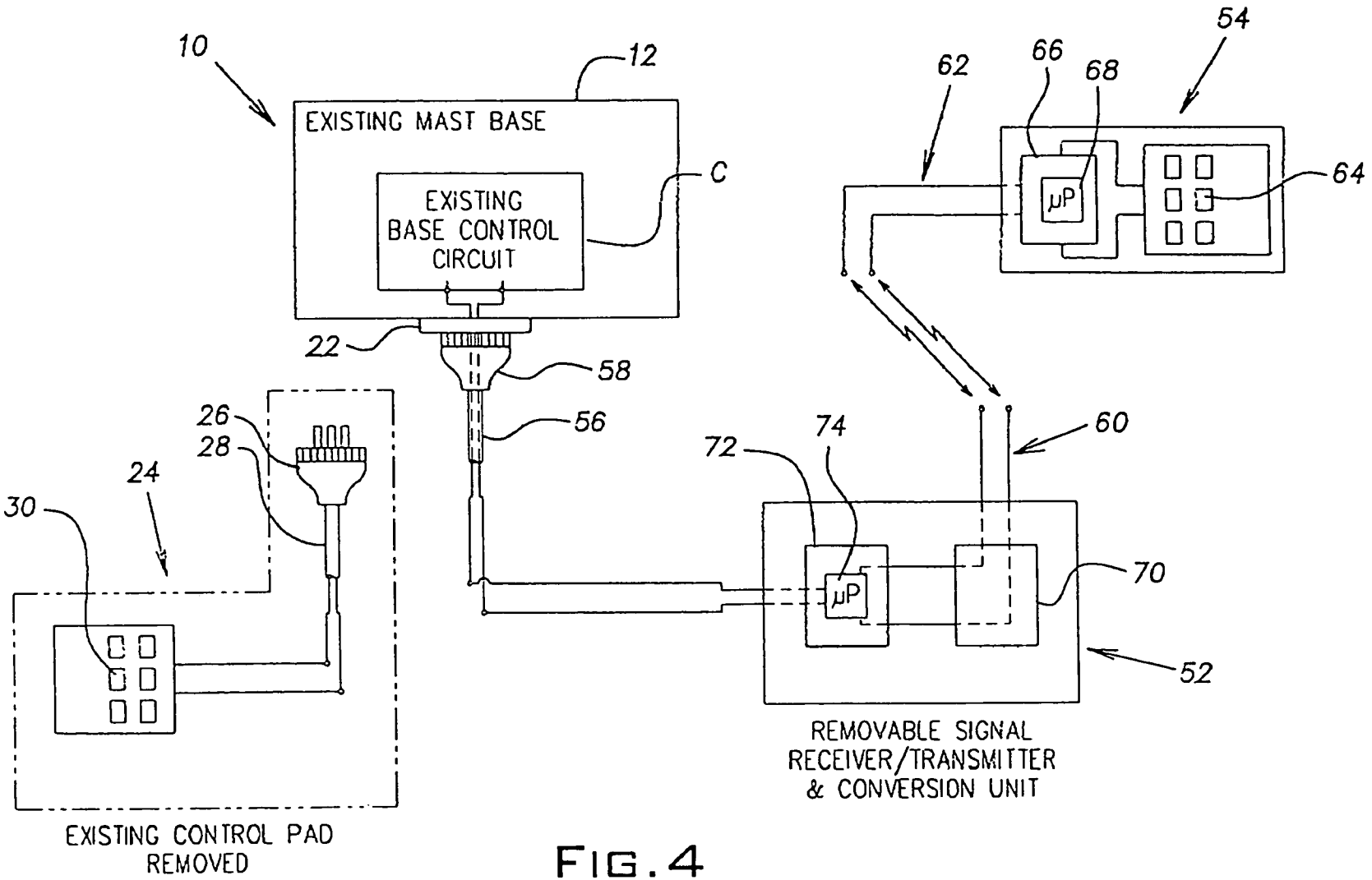
FIG. 4 is a schematic diagram of the command signal transmitting, receiving and conversion components of a wireless remote control system in accordance with the present invention.

As best illustrated in FIG. 4, remote control 54 includes a plurality of command keys 64 and a converter 66, and is powered by a self-contained power supply, not shown, such as a battery. Command keys 64 correspond to the various functions and movements of mast 14 and light 20 or other devices on the mast. It will be appreciated that different mast arrangements may require different command functions and, therefore, converter 66 may include a microprocessor 68 for programming the command keys to perform the desired functions. Additionally, converter 66 includes a transmitter and/or receiver, and converts command signals from keys 64 to electromagnetic signals transmitted from antenna 62. Converter 66 may also convert electromagnetic signals to provide information to remote control 54, such as illuminating LED lights. It will be appreciated that the electromagnetic signals transmitted between remote control 54 and base unit 52 may be comprised of electromagnetic waves in any of a variety of frequency or power ranges, and that the use of any such suitable frequency or power range will generally determine the distance from which remote control 54 can effectively operate base unit 52. It will be further appreciated that other technologies, such as spread spectrum or coding technology, may be used to make control of the mast and its accessories more secure, or minimize interference between wireless remote control devices, such as when multiple mast arrangement are deployed in one area.

In addition to the antenna, cord and plug thereof, base unit 52 is comprised of a receiver/transmitter unit 70 and a conversion unit 72. Receiver/transmitter unit 70 receives and transmits electromagnetic command signals from and to remote control 54. Such command signals are typically not suitable to directly communicate with the control system of mast arrangement 10. Accordingly, conversion unit 72 of base unit 52 converts the output from receiver/transmitter unit 70, that corresponds to the command signals from remote control 54, into electrical signals suitable for communication with the control system of mast arrangement 10. Such electrical signals will be substantially similar, if not identical, to the electrical signals outputted by control pad 24. As with remote control 54, conversion unit 72 includes a microprocessor 74 for programming the conversion of the electrical signals output by receiver/transmitter unit 70 to electrical signals suitable for communication with the control system of mast arrangement 10. This is desirable because of the wide variety of possible mast arrangements currently in existence and those under development.

Upon arrival of the vehicle and operator at the location of deployment, mast arrangement 10 will be suitably stowed. Particularly, mast 14 may be telescopically collapsed and extending in a generally horizontal direction. In prior art mast arrangements, plug 26 of wired control pad 24 would be interengaged with port 22 to place pad 24 and the control system of mast arrangement 10 in electrical communication. However, utilizing the device in the subject application, plug 58 of base unit 52 is interengaged with port 22 to place base unit 52 and the control system of the mast in electrical communication. Base unit 52 may be suitably supported on vehicle V adjacent port 22, such as by magnets, hooks and the like. Wireless remote control 54 can then be used to send command signals to the control system of mast arrangement 10 by the reception and conversion of the electromagnetic signals by base unit 52, and thereby control the movements of the mast 14 and the devices thereon. Once the need for or use of the mast has passed, remote control 54 can be used to stow the mast arrangement, and base unit 52 can then be disconnected and, together with the remote control 54, can be stowed in the vehicle for later use.

While considerable emphasis has been placed herein on the structures and structural interrelationships between the component parts of the embodiment disclosed, it will be appreciated that other embodiments of the invention can be made and that many changes can be made in the embodiment illustrated and described without departing from the principals of the invention. Accordingly, it is to be distinctly understood that the foregoing descriptive matter is to be interpreted as merely illustrative of the present invention and not as a limitation.

What is claimed is:

1. A wireless remote control system for retrofitting an extendable mast arrangement having an existing control system for wireless remote control operation, the extendable mast arrangement including a communication port for a wired control pad, said wireless remote control system comprising:

a wireless remote control that generates at least one command signal corresponding to at least one function of said mast arrangement; and, a base unit adapted to receive said command signals from said wireless remote control, said base unit used in place of the wired control pad and adapted to engage said communication port to place said base unit and the existing control system in electrical communication to thereby communicate control signals to said existing control system.

2. The wireless remote control system as defined in claim 1, wherein said generated command signal includes an electromagnetic signal.

3. The wireless remote control system as defined in claim 1, wherein said base unit includes a converter to convert said received command signals to said control signals that are recognized by said existing control system.

4. The wireless remote control system as defined in claim 1, wherein said command signals operate at least one function of a device connected to said mast.

5. The wireless remote control system as defined in claim 1, wherein said base unit is detachably connected to said existing control system.

6. A wireless remote control system for converting an extendable mast arrangement from wired remote control operation to wireless remote control operation, the extendable mast arrangement being supported on a vehicle and having an existing mast control system adapted to receive electrical impulses from an associated wired control unit through a communication port, said wireless remote control system comprising:

a wireless remote control adapted to generate a command signal corresponding to a function of the mast arrangement; and, a base unit adapted to engage said communication port in place of the associated wired control unit, receive said command signal from said wireless remote control, and to communicate a corresponding control signal to the control system.

7. The wireless remote control system as defined in claim 6, wherein said base unit is detachably connected to the control system at said communication port.

8. The wireless remote control system as defined in claim 6, wherein said command signal operates at least one function of a device connected to said mast arrangement.

9. The wireless remote control system as defined in claim 6, wherein said base unit includes a converter to convert said received command signals to said control signals that are recognized by said control system.

10. A method of outfitting an extendable mast system with a wireless remote control system, said extendable mast system having an existing wired control system including an existing wired control pad and a communication port for connecting with said existing control pad, said method comprising:

providing a wireless remote control adapted to output command signals in the form of electromagnetic waves and a base unit adapted to receive said command signals in the form of electromagnetic waves from said wireless remote control;

placing said base unit in electrical communication with the existing control system through said communication port; and, converting said electromagnetic waves into electrical impulses communicable to the existing control system.

11. The method as defined in claim 10, including the step of detachably connecting said base unit to said existing control system.

12. A method of converting an extendable mast system operative by wired remote control for operation using a wireless remote control system, said extendable mast system having a mast control system and a wired remote control unit adapted to communicate a control signal as an electrical impulse to said mast control system through a communication port, said method comprising steps of:

a) providing a wireless remote control adapted to generate a command signal corresponding to a function of the mast arrangement and providing a base unit adapted to receive said command signal from said wireless remote control;

b) placing said base unit in electrical communication with a mast control system through said communication port in place of the wired remote control; and, c) converting said command signals into corresponding control signals communicable to the mast control system through said communication port.

13. A method according to claim 12 further comprising a step of removing the wired remote control unit from electrical communication with the mast control system prior to step b).

14. A method according to claim 12, wherein said base unit includes an electrical cord having a plug formed thereon that is complimentary to said communication port and step b) includes interengaging said plug and said communication port.

15. A method according to claim 12, further comprising a step of communicating said command signal from said wireless remote control to said base unit.

16. A method according to claim 15, wherein said command signal in the form of an electromagnetic wave, and said step of communicating includes broadcasting said electromagnetic wave between said wireless remote control and said base unit.

17. A method according to claim 16, wherein said wireless remote control and said base unit includes a transmitter and said base unit includes a receiver, said step of communication includes broadcasting said electromagnetic wave from said wireless remote control to said base unit.

18. A wireless remote control conversion kit for use with an associated extendable mast having an associated existing mast control system adapted to receive electrical impulses from an associated wired control unit through an associated communication port and for converting the associated mast system for wireless remote control operation, said wireless remote control kit comprising;

a wireless remote control unit adapted to generate a mast command signal corresponding to a function of the associated extendable mast system; and, a base unit having an electrical cord extending therefrom and terminating at a plug complimentary to the associated communication port, said base unit adapted to output an electrical impulse corresponding to said command signal along said electrical cord to said plug.

19. A wireless remote control kit according to claim 18, wherein said mast command signal is in the form of an electromagnetic signal broadcast between said wireless remote control and said base unit.

20. A wireless remote control kit according to claim 18, wherein said base unit includes a converter adapted to convert said mast command signal into a control signal in the form of said electrical impulse that is recognizable by the associated mast control system.

* * * * *